US005456390A

United States Patent [19]

McFarland

[11] Patent Number: 5,456,390

[45] Date of Patent: Oct. 10, 1995

[54] ATHLETIC GLOVE POCKET FORMING AND SHAPING DEVICE

[76] Inventor: Kelly B. McFarland, 60 Marvin Ct., Simi Valley, Calif. 93065

[21] Appl. No.: 266,529

[22] Filed: Jun. 28, 1994

[51] Int. Cl.[6] ..... A41D 1/00; A63B 67/00; A63B 71/00

[52] U.S. Cl. ..... 223/78; 273/25

[58] Field of Search ..... 223/78, 79, 80, 223/84; 2/19; 206/315.1; 273/26 R, 25

[56] References Cited

U.S. PATENT DOCUMENTS

| | | | |
|---|---|---|---|
| 3,953,030 | 4/1976 | Muchnick | 2/19 |
| 4,418,849 | 12/1983 | Santa | 223/78 |
| 4,637,610 | 1/1987 | Carr | 273/26 |
| 4,765,519 | 8/1990 | Groves | 223/78 |
| 4,958,729 | 9/1990 | Wright | 206/315.1 |
| 5,000,317 | 3/1991 | Cich | 206/315.1 |
| 5,267,677 | 12/1993 | Nash | 223/78 |

*Primary Examiner*—C. D. Crowder
*Assistant Examiner*—Bibhu Mohanty
*Attorney, Agent, or Firm*—Jack C. Munro

[57] ABSTRACT

An athletic glove pocket forming and shaping device which seeks to form an elongated, slightly stretchable strap formed of a fabric material. The outer end of the strap includes a compartment housing and that has a compartment and within that compartment is to be located a ball. The compartment housing and the ball are to be inserted within the interior of an athletic glove such as a baseball glove with the strap extending exteriorly of the baseball glove. The strap is then to be wound around the glove in a tight fitting manner and secured in that position. The compartment is capable of connecting with different sizes of ball.

6 Claims, 1 Drawing Sheet

ATHLETIC GLOVE POCKET FORMING AND SHAPING DEVICE

BACKGROUND OF THE INVENTION

1) Field of the Invention

The field of this invention relates generally to softball and baseball, and more particularly, to a device for forming the pocket of a baseball or softball glove during the time that the glove is not being used.

2) Description of the Prior Art

Gloves used for baseball and softball have a pocket in the palm of the glove that is designed to fit the ball size of that particular sport. These pockets have a natural curvature designed to conform to the hand of the player wearing the glove. The gloves are fabricated of leather which is a material that undergoes dimensional changes when moistened. The gloves are often mistreated following use and are usually placed in a locker or bag without any protection for maintaining the shape of the glove and without any provision to maintain the shape of the pocket of the glove. Since the gloves usually become moist with perspiration and oils during use, the gloves are very prone to deform in a locker or storage bag, particularly when other gear or clothing is placed on top of the glove.

Creating a pocket in a baseball and softball glove helps a player field balls and makes the glove more comfortable. Better fielding enhances the player's ability to play the game with fewer errors. Serious baseball and softball players in the past have stuffed a wad of fabric, a baseball or softball into the glove to protect the pocket of the glove when the glove is not being used. Generally just putting a softball or baseball into the glove when the glove is not in use will not help form the pocket of the glove because the ball will just easily roll free of the glove.

When a glove is newly purchased by a player, such a glove does not have the proper pocket formed for the type of ball to be played and it is necessary for the player to form the desired pocket. It is common for the player to repeatedly toss a ball into his or her own glove in order to form the correct pocket. However, after the glove is used and then placed in storage, the pocket is again lost and it is necessary for the player, on taking up the glove again, to repeat the steps of tossing the ball into the glove to form the needed pocket. This takes some time and when hastily done, the pocket may not be in the desired shape. It would be helpful to include some means to retain the pocket during storage so as to avoid the constant need for remaking the pocket before each use.

Besides, as previously mentioned, storing the glove with the ball or with a wad of fabric in the pocket of a glove, there have been attempts in the past to utilize a device which facilitates the forming of the pocket. However, these devices have been relatively expensive and complicated and have not experienced any widespread usage.

SUMMARY OF THE INVENTION

The primary objective of the present invention is to provide a device to be used to retain the pocket of a baseball or softball glove during storage.

Another objective of the present invention is to provide a pocket forming and shaping device that is easy to use by even the most unskilled individual and occupies a minimal amount of space in conjunction with the glove during storage.

A further object of the present invention is to provide a baseball/softball glove pocket forming and shaping device that keeps the pocket in the same condition no matter the length of storage.

A still further object of the present invention is to provide a baseball/softball pocket forming and shaping device that can be utilized in conjunction with both baseball gloves and softball gloves. Therefore, it can be varied to fit the type of ball that is being used and hence form the exact size of pocket within the glove according to the type of ball sport that is being played.

A still further object of the present invention is to provide a baseball/softball pocket forming and shaping device which is constructed of high quality, yet can be manufactured at a relatively inexpensive price.

The athletic glove pocket forming and shaping device of the present invention is designed to be used in conjunction with an athletic glove during the time that the athletic glove is not being used. The device comprises an elongated strap which is formed of a slightly stretchable fabric type of material. At the inner end of this strap there is formed one-half of a male/female fastener with the opposite connecting portion of the fastener being mounted adjacent the outer end of the strap. Also at the outer end of the strap is formed an internal compartment with this internal compartment to snugly retain a softball or loosely retain a baseball. When the baseball is located within this internal compartment, there is incorporated another male/female fastener which closes the internal compartment so as to keep the baseball in position within the internal compartment. The ball and the internal compartment are to be located within the pocket of the glove with this strap extending exteriorly of the glove then tightly wrapped around the glove and secured in position by the aforementioned first male/female fastener arrangement. This fastener arrangement permits adjustability so as to accommodate the different sizes of gloves and because of the stretchability of the strap, there is exerted a slight bias against the glove pressing the glove into the baseball facilitating the forming of the desired pocket within the glove. A hanging strap is connected to the elongated strap so as to permit hanging of the athletic glove pocket forming and shaping device during the time it is not being used in conjunction with a glove.

DETAILED DESCRIPTION OF THE SHOWN EMBODIMENT

Figure 1:
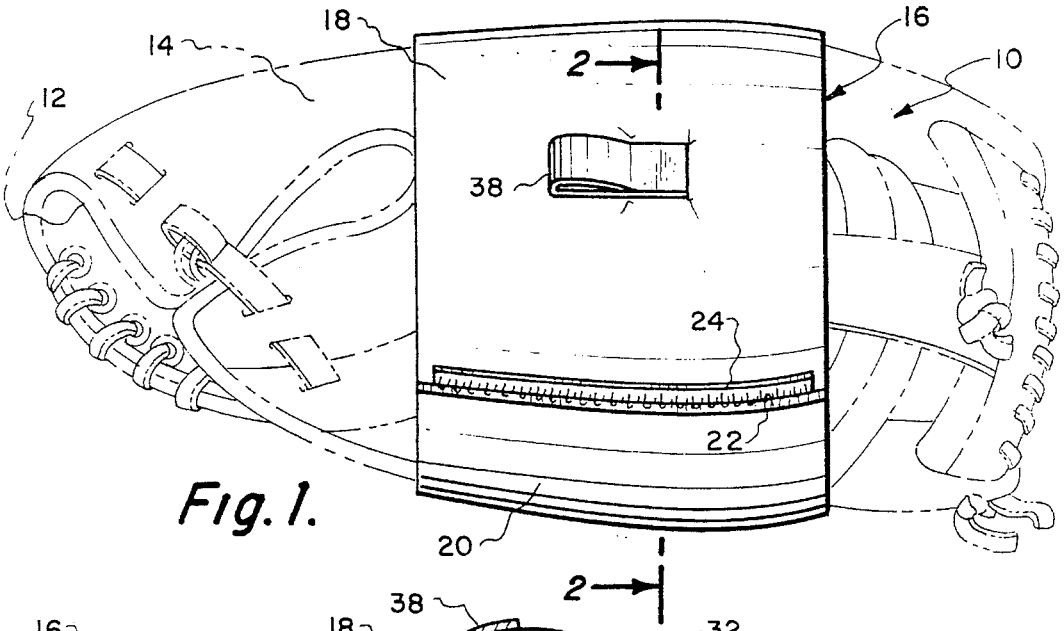
FIG. 1 is an exterior elevational view of the athletic glove pocketing forming and shaping device showing such being mounted in conjunction with a conventional softball glove.

Referring particularly to the drawing, there is shown a typical softball glove 10 which has a ball-catching internal chamber 12. The softball glove 10 normally occupies a position folded upon itself (basically U-shaped) substantially enclosing the ball-catching internal chamber 12. The glove 10 has an exterior surface 14.

Connected with the glove 10 in FIG. 1 is the athletic glove forming and shaping device 16 of this invention. The device 16 is composed of a thin, slightly stretchable fabric material, elongated strap 18. Typical material would be a rubberized fabric for the strap 18. Strap 18 may have any desired width, such as between four inches to six inches in width.

The strap 18 has an inner end 20 on which is mounted in a secure manner a fastener pad 22. The fastener pad 22 is to comprise one-half of a male/female fastener arrangement that is commonly sold under the trade name of VELCRO. Attached to the outer end of the strap 18 is another fastener pad 24. Fastener pad 22 is located on the inside surface of the strap 18 with fastener pad 24 being mounted on the outside surface of the strap 18. Pad 24 is shown to be about the same size as pad 22; however, size variation may be utilized. Also, configuration of the pads 22 and 24 may be different than what is shown. The pad 24 comprises the opposite portion of the male/female fastener from the pad 22. Therefore, when pads 22 and 24 are connected together, a secure connection results.

Also secured integrally and permanently to the outer end of the strap 18 is a compartment housing 26. Included within the compartment housing 26 is an internal compartment 28. Secured on opposite sidewalls of the compartment housing 26 at the entry opening into the internal compartment 28 are fastening strips 30 and 32. These strips 30 and 32 are capable of being secured together, closing the entry opening into the internal compartment 28.

Figure 2:
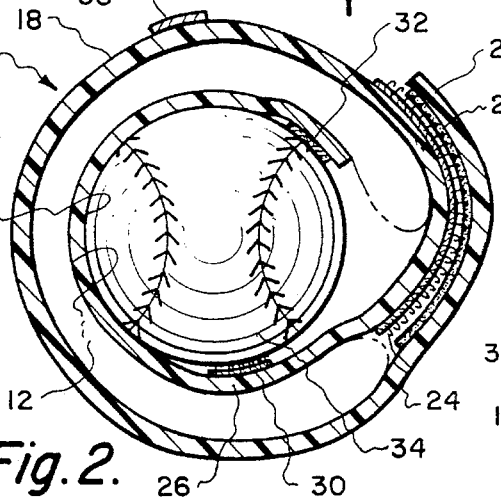
FIG. 2 is a cross-sectional view taken along line 2—2 of FIG. 1 showing the installed position of the athletic glove pocket forming and shaping device in conjunction with the softball glove.
Figure 3:
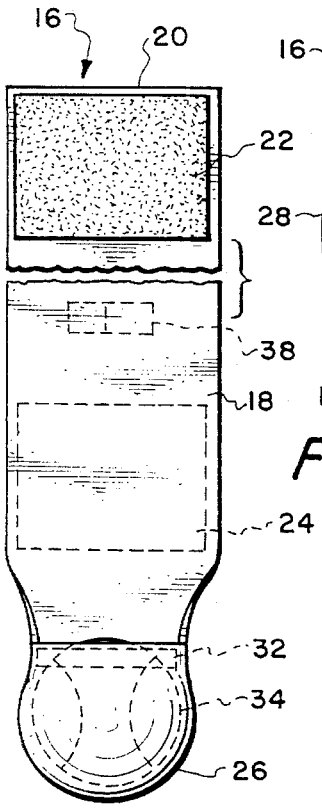
FIG. 3 is an elongated, uninstalled position of the athletic glove pocket forming and shaping device of this invention showing the device to be used in conjunction with a softball.
Figure 4:
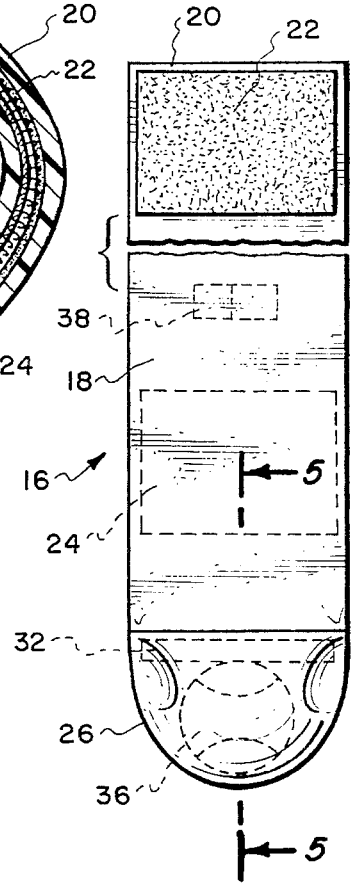
FIG. 4 is a view similar to FIG. 3 but showing the device used in conjunction with a baseball.
Figure 5:
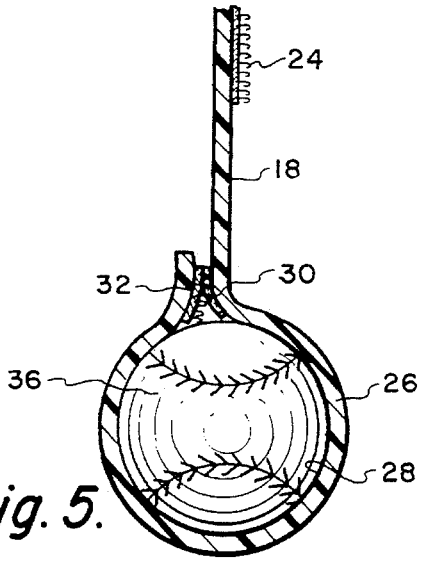
FIG. 5 is a cross-sectional view taken along line 5—5 of FIG. 4 showing the securing arrangement utilized to insure that the baseball is retained in conjunction with the pocket of the device.

The internal compartment 28 is selected to be of a size to snugly retain a softball 34. When the softball 34 is located within the internal compartment 28, the fastener strips 30 and 32 are not connected. This arrangement is clearly shown in FIG. 2 of the drawing. However, when a smaller sized ball such as baseball 36 is locatable within the internal compartment 28, the fastener strips 30 and 32 are connected together so as to keep the baseball 36 from accidentally dislodging from the internal compartment 28. This configuration for a softball is clearly shown in FIG. 5 of the drawing.

When the glove 10 is not being used, the appropriate sized ball, either softball 34 or baseball 36, is located within the internal compartment 28. If a baseball 36 is used, the fastener strips 30 and 32 are connected together. The compartment housing 26 is then placed within the pocket of the glove 10 which is located within the confines of the ball-catching internal chamber 12. The strap 18 then protrudes externally of the ball-catching interior chamber 12 and is then wrapped or wound about the exterior surface 14 of the glove 10. The strap 18 is then slightly stretched to assume a tightly wrapped configuration about the glove 10. At this particular time, the fastener pad 22 is then caused to engage to the fastener pad 24, securely holding the strap 18 in position. The glove 10 is then located in a storage position which may be for a period of weeks or months until it is time to again use the glove 10 in the playing of either a baseball or softball game. When the glove 10 is then to be used, the fastener pads 22 and 24 are disengaged and the compartment housing 26 is then removed from the ball-catching internal chamber 12. The leather material of glove 10 should now be formed into just the right sized pocket within the ball-catching internal chamber 12 thereby facilitating usage of the glove 10 in a more efficient and carefree manner in catching of balls.

During the time that the glove 10 is being used, the hanging strap 38 can be used to hang the athletic glove pocket forming and shaping device 16 on a hook or nail that would be mounted on some exterior structure such as within a dugout of a baseball game. The hanging device 38 is to be fixedly secured to the exterior surface 18 of the strap 16.

What is claimed is:

1. An athletic glove pocket forming and shaping device comprising:

an elongated strap terminating at an inner end and an outer end, one portion of a first male/female fastening assembly mounted on said inner end with the opposite portion of said first male/female fastening assembly mounted adjacent said outer end;

a compartment housing integrally and permanently attached to said elongated strap at said outer end, said compartment housing having an internal compartment which is adapted to contain a ball in a snug fitting manner; and whereby said compartment housing with said ball located in said internal compartment is to be located within the confines of an athletic glove and said elongated strap then tightly wound around the exterior surface of the athletic glove with said first male/female fastening assembly being engaged to tightly hold the athletic glove in position around said compartment housing containing said ball.

2. The athletic glove pocket forming and shaping device as defined in claim 1 wherein:

said elongated strap being slightly stretchable so as to apply a continuous force against the athletic glove when said elongated strap is tightly wound therearound.

3. The athletic glove pocket forming and shaping device as defined in claim 2 wherein:

said first male/female fastening assembly being adjustable to occupy different secured positions so as to accommodate to different sizes of athletic gloves.

4. The athletic glove pocket forming and shaping device as defined in claim 3 wherein:

said internal compartment being capable of accommodating in a substantially snug fitting manner different sizes of balls.

5. The athletic glove pocket forming and shaping device as defined in claim 4 wherein:

said compartment housing including a second male/female fastener assembly, said second male/female fastener assembly to only be engaged when a smaller sized ball is located within said internal compartment to thereby snugly secure in position the ball within said internal compartment.

6. The athletic glove pocket forming and shaping device as defined in claim 5 including:

a hang-up strap mounted on said elongated strap, said hang-up strap to be utilized to store said athletic glove pocket forming and shaping device in a stowed position when said device is not being used.

* * * * *